US007742718B2

(12) United States Patent
Hashizume et al.

(10) Patent No.: US 7,742,718 B2
(45) Date of Patent: Jun. 22, 2010

(54) DEVELOPING DEVICE PREVENTING DAMAGE BY TONER AND IMAGE FORMING APPARATUS HAVING THE SAME

(75) Inventors: Masahiro Hashizume, Osaka (JP); Masanobu Maeshima, Osaka (JP); Teruhiko Inada, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 98 days.

(21) Appl. No.: 11/790,824

(22) Filed: Apr. 27, 2007

(65) Prior Publication Data

US 2007/0253727 A1 Nov. 1, 2007

(30) Foreign Application Priority Data

Apr. 28, 2006 (JP) ..... 2006-124677

(51) Int. Cl.
*G03G 15/00* (2006.01)

(52) U.S. Cl. ..... 399/103

(58) Field of Classification Search ..... 399/103, 399/265, 279, 286, 102, 105
See application file for complete search history.

(56) References Cited

U.S. PATENT DOCUMENTS 5,489,974 A * 2/1996 Kamaji et al. ..... 399/285
6,640,076 B2 * 10/2003 Shintani ..... 399/276
6,980,752 B2 * 12/2005 Kamimura ..... 399/103

FOREIGN PATENT DOCUMENTS

| | | | |
|---|---|---|---|
| JP | 2001-100525 | | 4/2001 |
| JP | 2001242660 A | * | 9/2001 |
| JP | 2004037667 A | * | 2/2004 |
| JP | 2004-191430 | | 7/2004 |

OTHER PUBLICATIONS

Computer translation of JP2004-37667A; Computer translation of JP2001-242660A.*

* cited by examiner

*Primary Examiner*—Quana M Grainger
(74) *Attorney, Agent, or Firm*—Smith, Gambrell & Russell, LLP

(57) ABSTRACT

A developing device includes: a developing roller that supplies toner so as to develop an electrostatic latent image into a toner image; and a seal member that prevents toner from leaking from end portions in the axial direction of the developing roller to the outside and the developing device is characterized by a structure in that the developing roller includes a sheet member disposed so as to cover the surface of the end portions in the axial direction of the developing roller, and the sheet member has no seam in the circumferential direction, and has a surface roughness that is smaller than that of the developing roller, or has a surface hardness that is higher than that of a synthetic resin as a base material of the toner.

12 Claims, 13 Drawing Sheets

DEVELOPING DEVICE PREVENTING DAMAGE BY TONER AND IMAGE FORMING APPARATUS HAVING THE SAME

This application is based on Japanese Patent Application No. 2006-124677 filed on Apr. 28, 2006, the contents of which are hereby incorporated by reference.

BACKGROUND OF THE INVENTION

1. Field of the Invention

The present invention relates to a developing device that can be applied to an electro photographic type image forming apparatus typified by a copying machine or a printer. In addition, the present invention relates to an image forming apparatus equipped with the developing device.

2. Description of Related Art

A photoconductor drum is widely used as an image carrier in an electro photographic type image forming apparatus such as a copying machine or a printer. A typical image forming operation using a photoconductor drum is performed as follows. The surface of the photoconductor drum is electrostatically charged at a predetermined potential uniformly by an electrification device, and a light beam from an LED or the like of exposing device is projected to the surface of the photoconductor drum. As a result, the potential is attenuated optically in a part so that an electrostatic latent image of an original image is formed. This electrostatic latent image is developed by a developing device so that a toner image is formed. After the toner image is transferred to a sheet of paper, a cleaning device cleans the surface of the photoconductor drum so as to remove remaining toner. Then, a charge eliminating device emits charge eliminating light for eliminating electric charge as a preparation for the next image forming operation.

In the developing device that is a main part of the image forming operation as described above, a general method for developing an electrostatic latent image is to make toner adhere to a surface of a developing roller and to transfer the toner from the surface of the developing roller to the surface of the image carrier by electrostatic force. At this point, in order to realize a long life of the device and to maintain a good image quality, seal members are provided to both end portions in the axial direction of the developing roller so as to prevent the toner from leaking to the outside of the developing roller in the axial direction. An example of this developing device is disclosed in JP-A-2001-100525.

The method for preventing leakage of toner in the developing device as described in JP-A-2001-100525 is widely used because it can be easily adopted with a relatively simple structure. However, since this developing device has a structure in which the both end portions of the developing roller to which the seal members contact are also made of a conductive material, toner can adhere easily to these portions with electric action. In other words, toner can enter easily between the developing roller and the seal member. When toner enters between the developing roller and the seal member, the toner may be melted by frictional heat due to rotation of the developing roller and then may fix so as to affect badly and largely to life of the developing roller.

In order to solve this problem, there is proposed a method that makes it difficult for toner to enter between the developing roller and the seal member in the developing device. An example of the method is described in JP-A-2004-191430. According to the developing device described in JP-A-2004-191430, the end portions of the developing roller to which the seal members contact are made of a nonconductive material.

Since the end portions of the developing roller to which the seal members contact are made of a nonconductive material in the developing device described in JP-A-2004-191430, electric action does not work in these portions so that toner can hardly enter between the developing roller and the seal member. However, very complicated structure that requires much time and effort is necessary, which includes bonding a conductive material and a nonconductive material to each other on a bonding face having a special shape with adhesive and polishing the surface of the roller, for example, so that the end portions of the developing roller to which the seal members contact are made of nonconductive material. Therefore, cost of components and manufacturing cost are increased largely. It is desired to design the developing roller that can prevent toner from entering between the developing roller and the seal member, remaining, melting, and fixing there with a simple structure that can be realized at a low cost.

In addition, not only electric action but also surface roughness and surface hardness of the developing roller affect largely to transfer of toner. In other words, even if countermeasure is taken in consideration of electric action for preventing toner from entering between the developing roller and the seal member, the toner may be transferred by action of the surface roughness and surface hardness of the developing roller so as to enter between them. Furthermore, if the surface roughness of the developing roller is large, the toner that has entered between the developing roller and the seal member is difficult to go out and may remain. In addition, if the surface roughness is large, frictional heat as well as melting and fixing of the toner is easily generated between the developing roller and the seal member. The developing devices described in JP-A-2001-100525 and JP-A-2004-191430 do not have countermeasures against the generation of transfer of toner and frictional heat due to the surface roughness and surface hardness of the developing roller, so they tend to be in a state where toner can easily enter, remain, melt, and fix in a sealed portion of the developing roller. The melting and fixing of toner in the sealed portion of the developing roller may cause breakage of the developing roller or deterioration in image quality.

SUMMARY OF THE INVENTION

In view of the above described problem, it is an object of the present invention to provide a developing device that can prevent toner from entering, remaining, melting, and fixing between the developing roller and the seal member so that a long life of the device can be obtained while maintaining good image quality with a simple structure that can be realized at a low cost. In addition, it is another object of the present invention to provide a high performance image forming apparatus equipped with the developing device.

In order to attain the above described first object, a developing device in accordance with one aspect of the present invention includes: a developing roller that supplies toner so as to develop an electrostatic latent image into a toner image; and a seal member that prevents toner from leaking from end portions in the axial direction of the developing roller to the outside. Further, the developing device is characterized by a structure in which the developing roller includes a sheet member disposed so as to cover the surface of the end portions in the axial direction of the developing roller, and the sheet member has no seam in the circumferential direction, and has a surface roughness that is smaller than that of the developing roller, or has a surface hardness that is higher than that of a synthetic resin as a base material of the toner.

A developing device according to second aspect of the present invention is characterized by a structure in which the sheet member has a surface hardness that is higher than that of a synthetic resin as a base material of the toner, or the sheet member has a surface roughness that is smaller than that of the developing roller in the above described first aspect of the present invention.

A developing device according to third aspect of the present invention is characterized by a structure in which the sheet member is made of a heat shrinkable material in the above described first aspect of the present invention.

A developing device according to fourth aspect of the present invention is characterized by a structure in which the sheet member has a local portion having a diameter that is smaller than that of the developing roller in the above described first aspect of the present invention.

A developing device according to fifth aspect of the present invention is characterized by a structure in which the sheet member covers a region from the surface of the end portions in the axial direction of the developing roller to the end surface of the roller portion, and an adhering member is provided between the end surface of the developing roller and the sheet member in the above described first aspect of the present invention.

A developing device according to sixth aspect of the present invention further includes a regulating plate for forming a thin layer of the toner on the surface of the developing roller. And the developing device is characterized by a structure in which the regulating plate contacts with the developing roller by one surface, and a length from the contact spot to the end is shorted in a region with the sheet member than in a region without the sheet member in the above described first aspect of the present invention.

To attain the above described second object, an image forming apparatus in accordance with seventh aspect of the present invention is equipped with a developing device according to any one of the above described first to sixth aspect of the present invention.

According to the present invention, a developing device including: a developing roller that supplies toner so as to develop an electrostatic latent image into a toner image; and a seal member that prevents toner from leaking from end portions in the axial direction of the developing roller to the outside. And the developing device is characterized by a structure in which the developing roller includes a sheet member disposed so as to cover the surface of the end portions in the axial direction of the developing roller, and the sheet member has a surface roughness that is smaller than that of the developing roller, or the sheet member has a surface hardness that is higher than that of a synthetic resin as a base material of the toner, and has no seam in the circumferential direction. By this arrangement, more slips are generated in the region with the sheet member than in the region without the sheet member, so that the toner hardly enter and remain between the developing roller and the seal member in the former region. Further, the frictional heat between the developing roller and the seal member is also hardly generated. Therefore, it is able to prevent toner from entering, remaining, melting, and fixing between the developing roller and the seal member with a more simple structure that can be realized at low cost. As a result, the developing device that has a long life and can maintain good image quality can be obtained.

The sheet member has a surface hardness that is higher than that of a synthetic resin as a base material of the toner, or the sheet member has a surface roughness that is smaller than that of the developing roller. By this arrangement, it is able to suppress damage to the sheet member due to friction with the toner. Thus, it is able to enhance the function of preventing the toner from remaining and generation of frictional heat between the developing roller and the seal member. Therefore, melting and fixing of the toner in the sealed portion of the developing roller become hardly generated.

The sheet member is made of a heat shrinkable material. By this arrangement when the sheet member is heated to be shrunk, it can be provided to the surface of the end portions of the developing roller. Therefore, it is able to realize the function of preventing toner from entering, melting and the like between the developing roller and the seal member with a much lower cost and simpler structure.

The sheet member has a local portion having a diameter that is smaller than that of the developing roller. By this arrangement, the sheet member is caught in the developing roller and blocks movement of the developing roller in the axial direction. Thus, the sheet member is retained in a predetermined position on the surface of the developing roller, so that the function of preventing toner from entering and melting in the sealed portion of the developing roller can work stably.

The sheet member covers a region from the surface of the end portions in the axial direction of the developing roller to the end surface of the roller portion, and an adhering member is provided between the end surface of the developing roller and the sheet member. By this arrangement, movements of the sheet member in the axial direction and in the circumferential direction of the developing roller are blocked. Therefore, the sheet member is fixed securely at a predetermined position on the surface of the developing roller so that the function of preventing toner from entering and melting in the sealed portion of the developing roller can work more stably.

The developing device further includes a regulating plate for forming a thin layer of the toner on the surface of the developing roller. And the developing device is characterized by a structure in which the regulating plate contacts with the developing roller by one surface, and a length from the contact spot to the end is shorted in a region with the sheet member than in a region without the sheet member. By this arrangement, a space between the developing roller and the regulating plate at the region of the end of the regulating plate becomes smaller in the region with the sheet member than in the region without the sheet member. Thus, quantity of toner remaining between the developing roller and the regulating plate in the region with the sheet member can be reduced. Therefore, the function of preventing toner from entering between the developing roller and the seal member can be further enhanced.

In addition, since the above mentioned developing device is provided to the image forming apparatus of the present invention, it is able to obtain a high performance image forming apparatus that can prevent toner from entering, remaining, melting, and fixing between the developing roller and the seal member so that a long life of the apparatus can be obtained while maintaining good image quality with a simple structure that can be realized at a low cost.

DETAILED DESCRIPTION OF THE PREFERRED EMBODIMENTS

Hereinafter, embodiments of the present invention will be described with reference to FIGS. 1-13.

Figure 1:
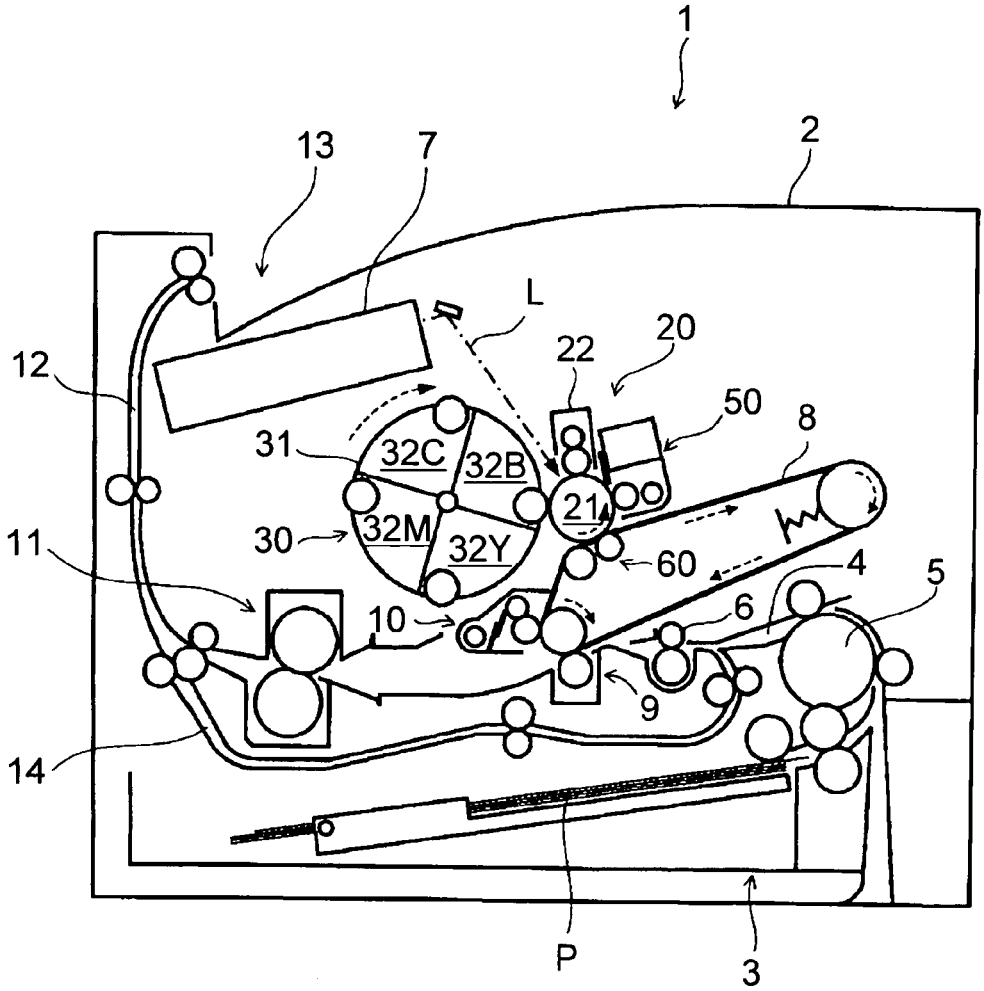
FIG. 1 is a schematic vertical cross sectional view when viewed from the left side of a printer equipped with a developing device according to a first embodiment of the present invention.

First, a general structure of an image forming apparatus equipped with a developing device according to a first embodiment of the present invention will be described with reference to FIG. 1. FIG. 1 is a schematic vertical cross sectional view when viewed from the left side of a color printer that is an example of the image forming apparatus. This color printer is a type of using an intermediate transfer belt. In FIG. 1, the right side corresponds to the front side of the printer, while the left side corresponds to the rear side of the same.

As shown in FIG. 1, a paper sheet cassette 3 is disposed at the lower portion inside a main body 2 of a printer 1. Paper sheets P are laid and housed in the paper sheet cassette 3. The paper sheets P are fed out toward the upper right of the paper sheet cassette 3 in FIG. 1. The paper sheet cassette 3 can be drawn out horizontally from the front side of the main body 2, i.e., the right side in FIG. 1.

A paper feed path 4, a paper feed roller 5, a resist roller 6 and an image forming portion 20 are arranged at the downstream of the paper sheet cassette 3 in the paper feeding direction. The image forming portion 20 includes a photoconductor drum 21 that is a rotating image carrier disposed at the center of the image forming portion 20. The photoconductor drum 21 rotates counterclockwise in FIG. 1. An electrification device 22, a developing device 30 and a drum cleaning device 50 are arranged in this order around the photoconductor drum 21 in the rotation direction thereof.

A main part of the developing device 30 is made up of a rotating frame 31 that rotates clockwise in FIG. 1, and total four developing units 32 are arranged in the circumferential direction of the rotating frame 31 at equal spaces. The four developing units 32 includes a black developing unit 32B, a cyan developing unit 32C, a magenta developing unit 32M and yellow developing unit 32Y. The rotating frame 31 is driven by a driving means (not shown) to rotate so that each of the four developing units 32 is moved to the position opposed to the photoconductor drum 21 one by one for forming a toner image of each color on the surface of the photoconductor drum 21.

An optical system 7 is disposed above the image forming portion 20, and a laser beam L is projected toward the photoconductor drum 21. The dot and dash line shows an optical path of the laser beam L in FIG. 1.

Just beneath the photoconductor drum 21, there is disposed an intermediate transfer belt 8 that is an intermediate transfer member used in a shape of an endless belt. The intermediate transfer belt 8 is wound around and supported by a plurality of rollers, and it turns clockwise in FIG. 1. The intermediate transfer belt 8 is pressed to and contacts with the photoconductor drum 21 at the lower portion so as to form a primary transfer portion 60.

A secondary transfer portion 9 is disposed at the spot where intermediate transfer belt 8 meets the paper feed path. The paper sheet P is fed to enter a secondary transfer nip portion formed in the secondary transfer portion 9 and is pressed to the intermediate transfer belt 8 so that a toner image is transferred to the paper sheet P. A belt cleaning unit 10 is disposed at the downstream of the secondary transfer portion 9 in the paper feeding direction.

A fixing unit 11, a paper eject path 12 and a paper eject portion 13 are arranged at the downstream of the image forming portion 20 and the secondary transfer portion 9 in the paper feeding direction. The paper eject portion 13 is disposed on the upper face of the main body 2 at the position that enables the printed paper sheet P to be accessed externally.

A double-sided printing paper feed path 14 is disposed beneath the fixing unit 11 and secondary transfer portion 9 and above the paper sheet cassette 3. The double-sided printing paper feed path 14 branches from the paper eject path 12, passes beneath the fixing unit 11 and the secondary transfer portion 9 and joins the paper feed path 4 at the immediate upstream of the resist roller 6.

Figure 2:
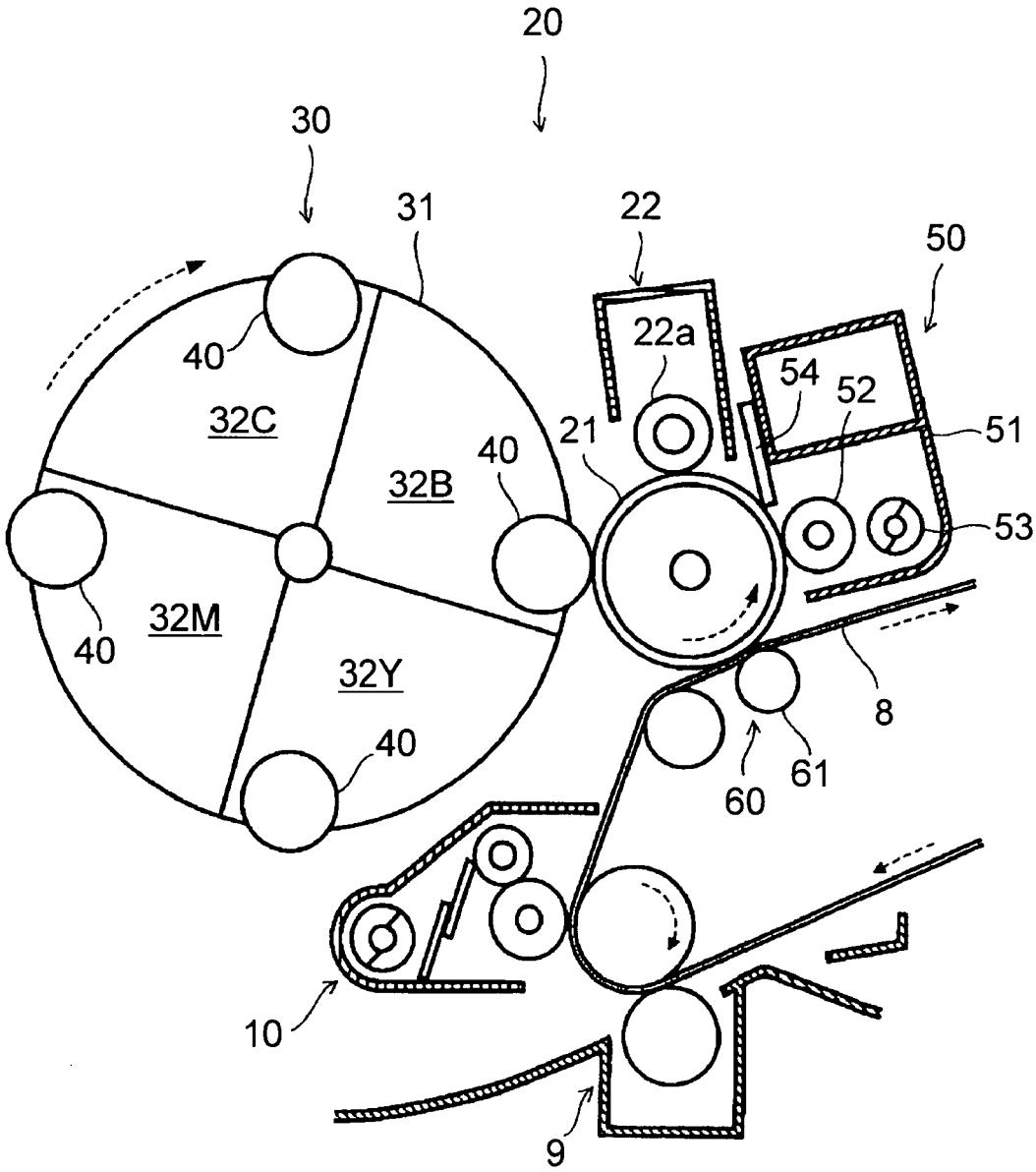
FIG. 2 is a magnified partial view of the vertical cross sectional view to show an image forming portion and its surrounding portions of the printer shown in FIG. 1.

Next, a detailed structure of the image forming portion 20 and its surrounding portions of the above mentioned printer 1 will be described with reference to FIG. 2. FIG. 2 is a magnified partial view of a vertical cross section of the image forming portion and its surrounding portions.

As shown in FIG. 2, the image forming portion 20 includes the photoconductor drum 21 that is an image carrier disposed at the center of the image forming portion 20. As described above, the electrification device 22, the developing device 30 and the drum cleaning device 50 are arranged in this order in the vicinity of the photoconductor drum 21 along the rotation direction of the photoconductor drum 21. The primary transfer portion 60 in which the photoconductor drum 21 and the intermediate transfer belt 8 are pressed to contact with each other is disposed between the developing device 30 and the drum cleaning device 50 along the rotation direction of the photoconductor drum 21.

The photoconductor drum 21 extends in the paper width direction that is perpendicular to the paper feeding direction in the printer 1, i.e., in the direction perpendicular to the paper in FIG. 2, and it is disposed so that the axial direction thereof becomes the horizontal. The photoconductor drum 21 is a drum of an inorganic photosensitive material that is manufactured by forming a photosensitive layer of amorphous silicon that is an inorganic photoconductive material by vacuum evaporation or the like on the outer surface of the conductive roller substrate made of aluminum or the like. The diameter of the drum is approximately 30 mm in this embodiment. The photoconductor drum 21 is driven by a driving device (not shown) to rotate at a circumferential speed that is substantially the same as a paper feeding speed (e.g., 210 mm/sec).

An electrification roller 22*a* that contacts with the photoconductor drum 21 is disposed inside the electrification device 22. The electrification roller 22*a* is pressed to the photoconductor drum 21 at a predetermined pressure and rotates together with the rotating photoconductor drum 21. This electrification roller 22*a* charges the surface of the photoconductor drum 21 at a predetermined polarity and potential uniformly.

As described above, the main part of the developing device 30 is made up of the rotating frame 31, and total four developing units 32 are arranged on the rotating frame 31 in the circumferential direction at equal spaces. Each of the developing units 32 is provided with a developing roller 40 that is a photosensitive noncontact type at the vicinity of the photoconductor drum 21. A bias voltage having the same polarity as the charge voltage of the photoconductor drum 21 is applied to the developing roller 40. This developing roller 40 charges toner that is developing powder, which is moved to the electrostatic latent image formed on the surface of the photoconductor drum 21 so that the electrostatic latent image is developed. The toner is filled in a toner supply container (not shown) and conveyed by a conveyer means (not shown) to the developing device 30 for supply. At this point, the detailed structure of the developing device 30 will be described later.

The primary transfer portion 60 includes a primary transfer roller 61 that contacts with the photoconductor drum 21 via the intermediate transfer belt 8. The primary transfer nip portion in which the photoconductor drum 21 and the intermediate transfer belt 8 contact with each other is formed at the spot where the primary transfer roller 61 is disposed. The primary transfer roller 61 has no driving device but contacts with the intermediate transfer belt 8 so as to rotate with the rotating intermediate transfer belt 8. In addition, a primary transfer bias voltage having the opposite polarity to the charge voltage of the photoconductor drum 21 and the toner is applied to the primary transfer roller 61 as necessity.

At this point, the intermediate transfer belt 8 is made up of a single layered resin belt formed with only a synthetic resin such as polyimide or the like or a laminated elastic belt with a rubber layer formed on the surface of the synthetic resin. It is wound around and supported by a plurality of rollers.

The drum cleaning device 50 is disposed at further downstream of the primary transfer portion 60 in the rotation direction of the photoconductor drum 21 as shown in FIG. 2. The drum cleaning device 50 includes a cleaning roller 52 and an ejection screw 53 inside a housing 51 thereof, and it includes a cleaning blade 54 between the housing 51 and the photoconductor drum 21.

The cleaning roller 52 and the cleaning blade 54 are pressed onto the photoconductor drum 21 by a force of an elastic member such as a spring (not shown) or the like. The cleaning roller 52 and the cleaning blade 54 extend in the axial direction of the photoconductor drum 21 and have substantially the same length as the photosensitive layer of the photoconductor drum 21 in the axial direction. In order that the cleaning is performed efficiently, the cleaning roller 52 is driven by a driving device (not shown) to rotate in the opposite direction to the rotation direction of the photoconductor drum 21 at a circumferential speed that is faster than a circumferential speed of the photoconductor drum 21 by approximately 15-20%. The cleaning roller 52 and the cleaning blade 54 remove the toner remaining on the surface of the photoconductor drum 21 so as to clean the same after the toner image is transferred onto the intermediate transfer belt 8. The toner that was removed from the surface of the photoconductor drum 21 is collected in the housing 51 temporarily and then is ejected by the ejection screw 53 externally.

Figure 3:
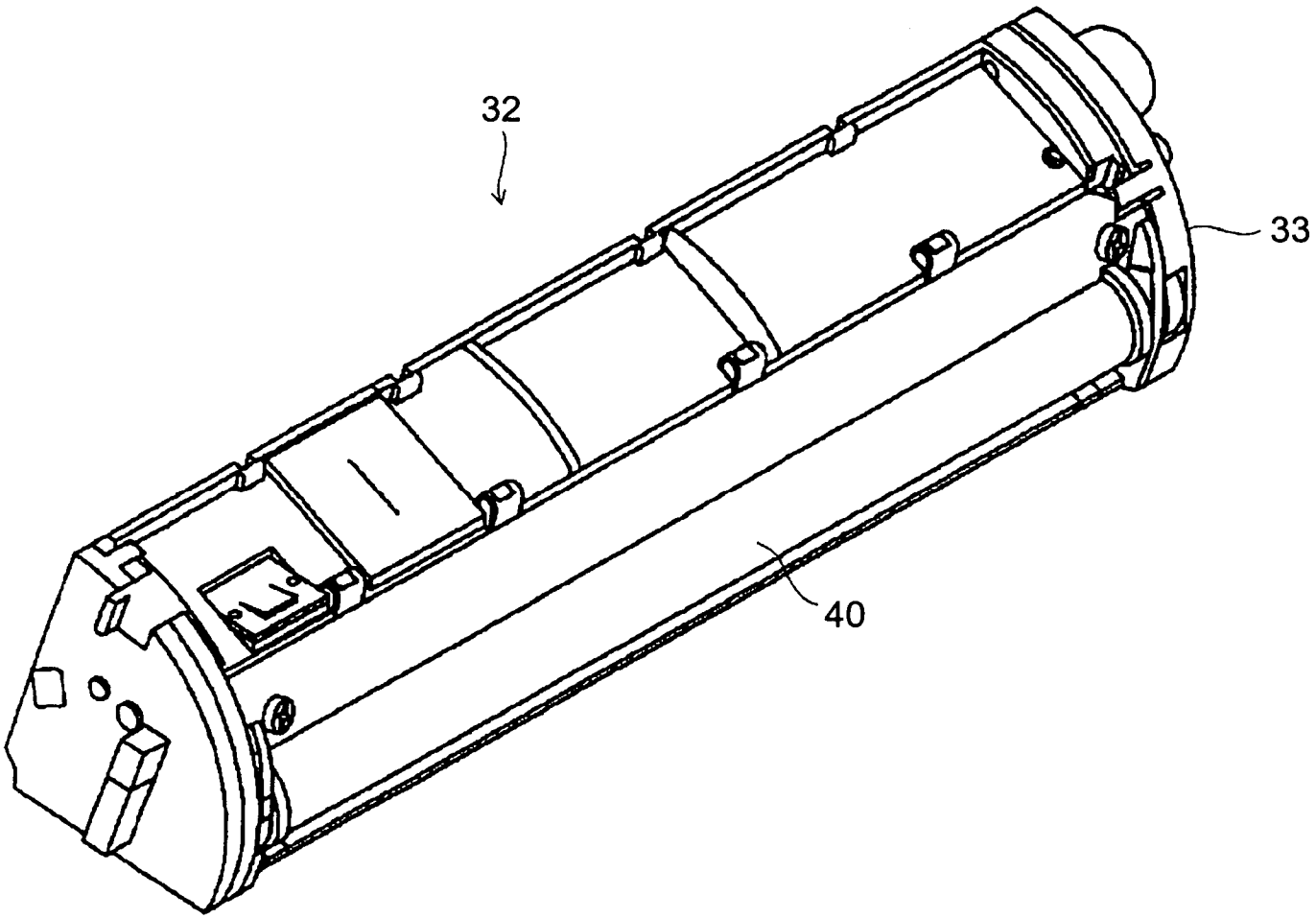
FIG. 3 is a perspective view of a developing unit that is provided to the developing device of the printer shown in FIG. 2.
Figure 4:
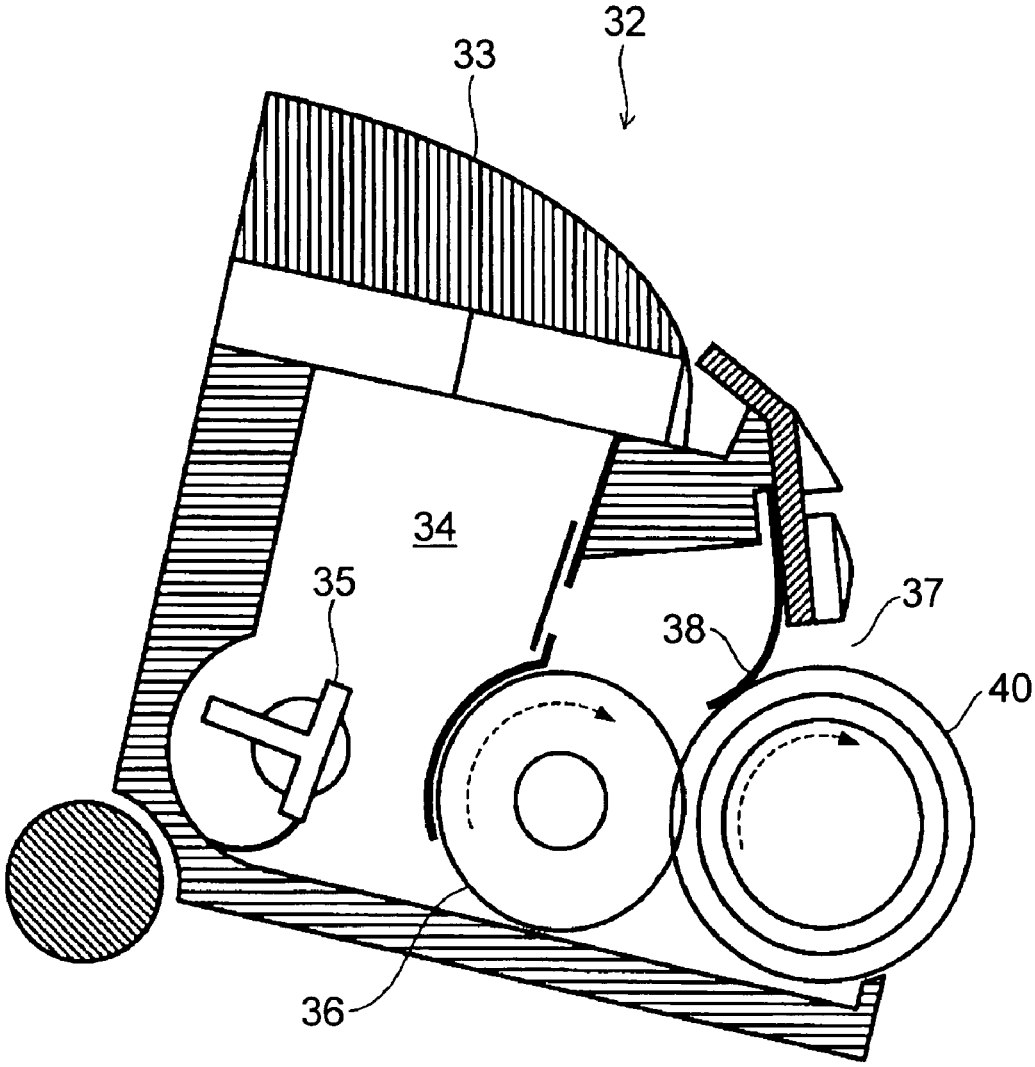
FIG. 4 is a vertical cross sectional view when viewed from the left side of the developing unit shown in FIG. 3.
Figure 5:
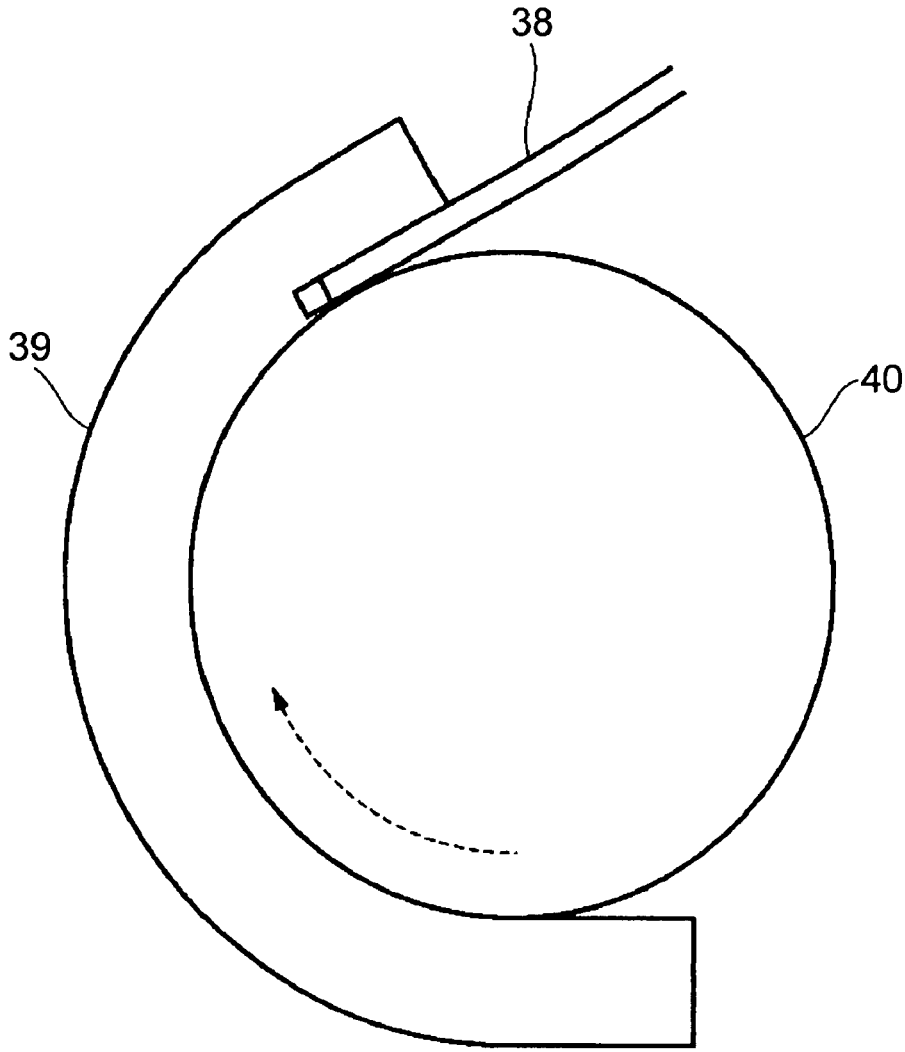
FIG. 5 is a schematic magnified partial view to show a developing roller and its surrounding portions of the developing unit shown in FIG. 4.

Next, a detailed structure of the developing device 30 will be described with reference to FIGS. 3 to 5 in addition to FIG. 2. FIG. 3 is a perspective view of a developing unit that is provided to the developing device of the printer shown in FIG. 2, FIG. 4 is a vertical cross sectional view when viewed from the left side of the developing unit shown in FIG. 3, and FIG. 5 is a schematic magnified partial view to show a developing roller and its surrounding portions of the developing unit shown in FIG. 4. At this point, the developing units 32 of four colors have a common fundamental structure, so the suffix "C", "M", "Y" and "B" indicating four colors will be omitted in the following description.

The developing device 30 shown in FIG. 2 includes the developing unit 32 shown in FIG. 3. The developing unit 32 has a case 33. The case 33 has a shape elongated in the axial direction of the photoconductor drum 21, i.e., in the direction perpendicular to the paper in FIG. 2, and it is disposed so that the longitudinal direction thereof becomes horizontal.

As shown in FIG. 4, there is a toner container 34 inside the case 33. The toner container 34 is provided with a stirring member 35 for stirring the toner and a feed roller 36 for feeding the toner to the developing roller 40 with their axes being horizontal.

The toner container 34 has an opening portion 37 at a part adjacent to the photoconductor drum 21. The developing roller 40 that is a carrier of developing powder is disposed at the opening portion 37. One side of the developing roller 40 is inside the toner container 34, and the other side thereof is exposed to the outside of the toner container 34 so as to face the photoconductor drum 21 that is the image carrier (see FIG. 2). The developing roller 40 is driven by a driving means (not shown) to rotate clockwise in FIG. 4.

A regulating plate 38 is disposed at a downstream of the inside part of the developing roller 40 in the toner container 34 in the rotation direction, i.e., at the upper portion of the developing roller 40 in FIG. 4. The regulating plate 38 is made of a synthetic resin or a thin metal film member and is dispose so that one surface thereof contacts with the developing roller 40 (see FIGS. 4 and 5). Thus, the regulating plate 38 forms a thin layer of toner on the surface of the developing roller 40, so that a constant volume of toner can be supplied to the photoconductor drum 21.

As shown in FIG. 5, seal members 39 are provided to the inner side of the toner container 34 on both end portions of the developing roller 40 in the axial direction. Each of the seal members 39 is provided to each end of the developing roller 40 in the axial direction. The seal member 39 is made up of felt, urethane, sponge, nonwoven fabric or the like, and it is disposed so as to contact with the surface of the developing roller 40 along the circumference of the developing roller 40 over a length of approximately half a circumference. This seal member 39 has a function of preventing the toner from leaking through a gap between each end portion of the developing roller 40 in the axial direction and the case 33.

Figure 6:
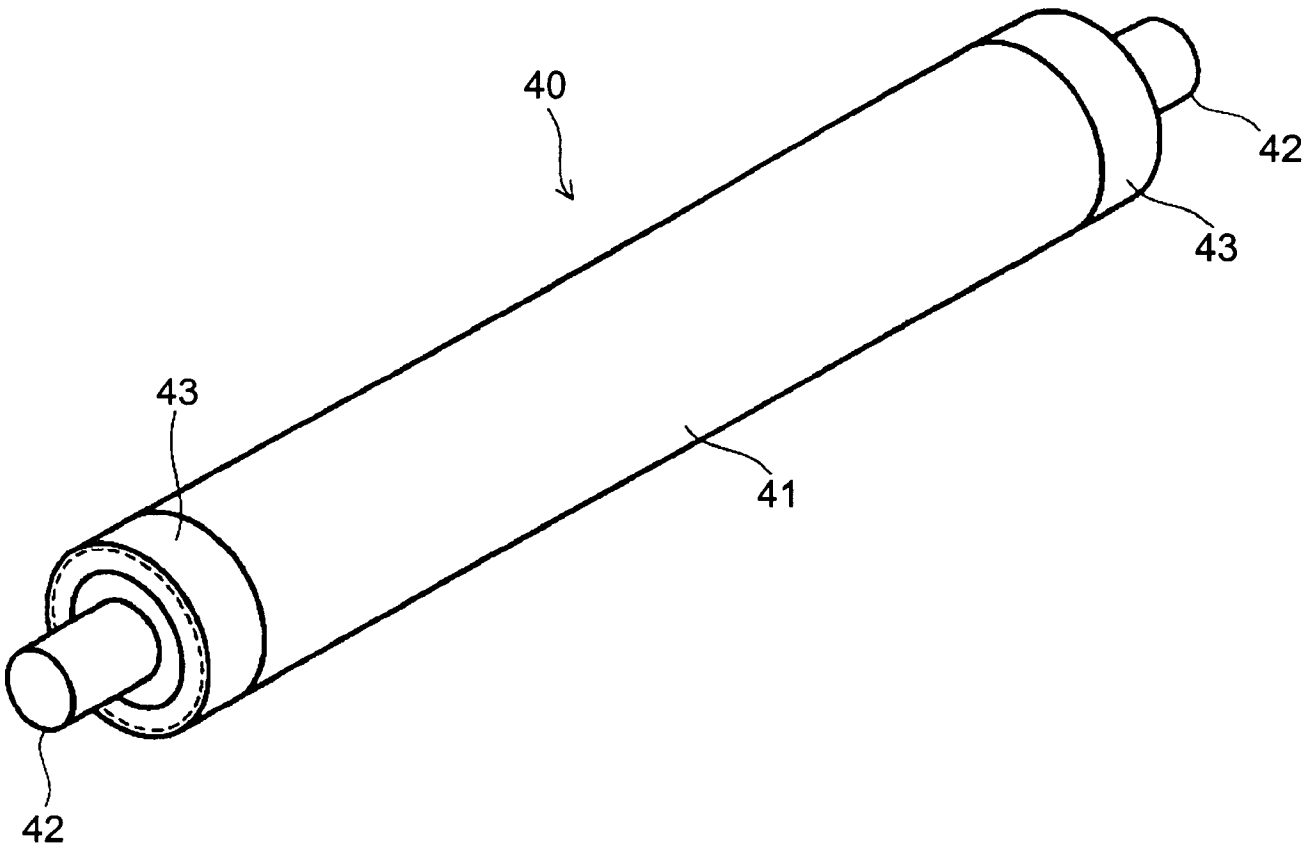
FIG. 6 is a perspective view of the developing roller of the printer shown in FIG. 3.
Figure 8:
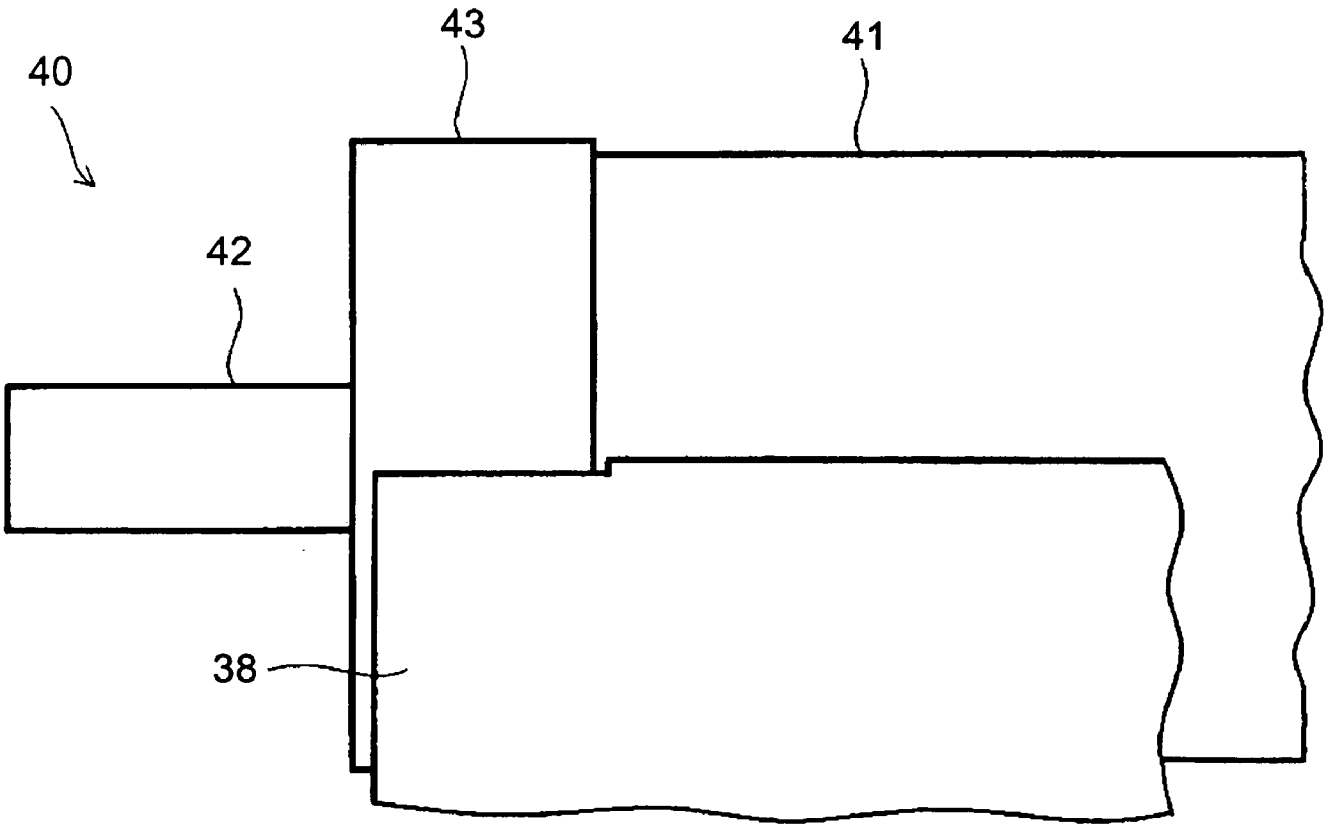
FIG. 8 is a magnified partial view to show a positional relationship between the developing roller and a regulating plate.
Figure 9:
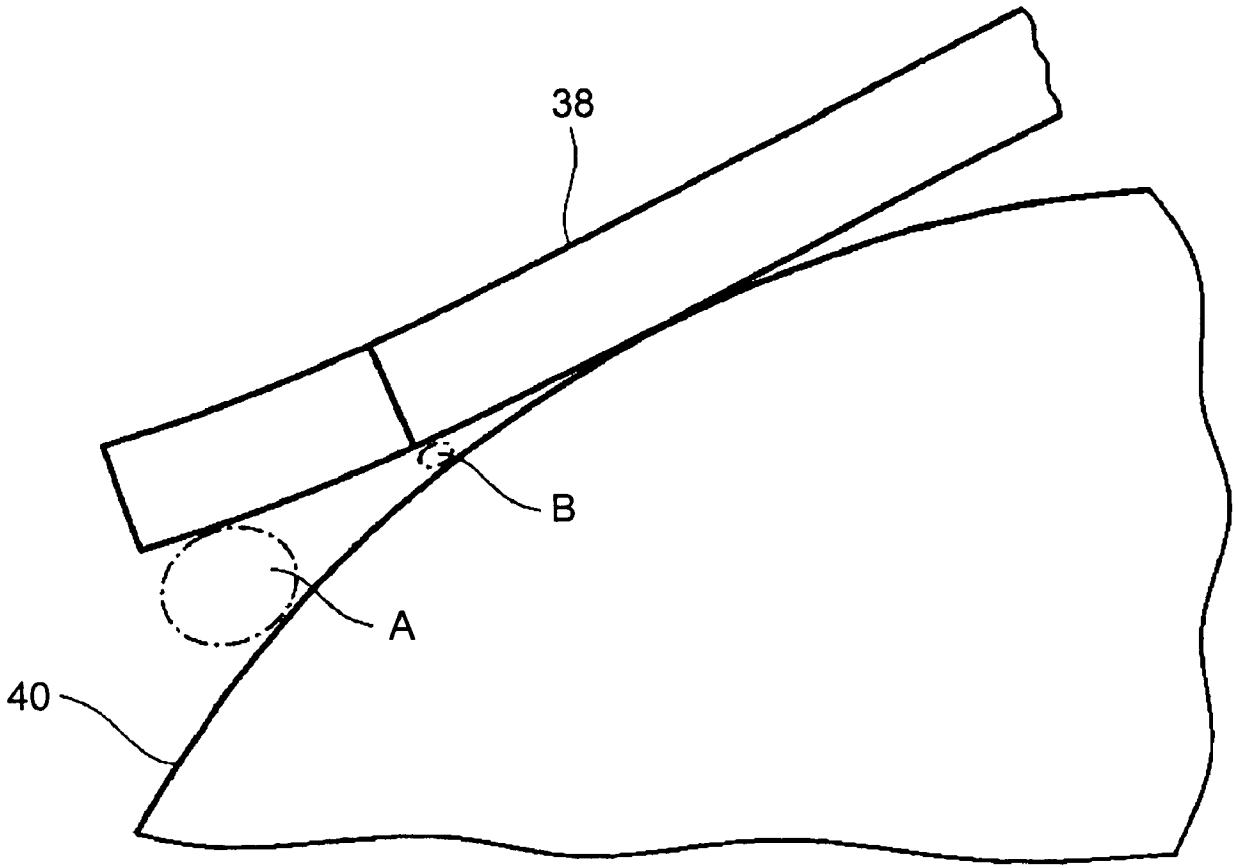
FIG. 9 is a magnified partial view to show a contact spot of the regulating plate that contacts with the developing roller.

Next, detailed structures of the developing roller 40 and the regulating plate 38 will be described with reference to FIGS. 6-9. FIG. 6 is a perspective view of the developing roller, FIG. 7 is a magnified partial view of a vertical cross section of the developing roller, FIG. 8 is a magnified partial view to show a positional relationship between the developing roller and the regulating plate, and FIG. 9 is a magnified partial view to show a contact spot of the regulating plate that contacts with the developing roller.

Figure 7:
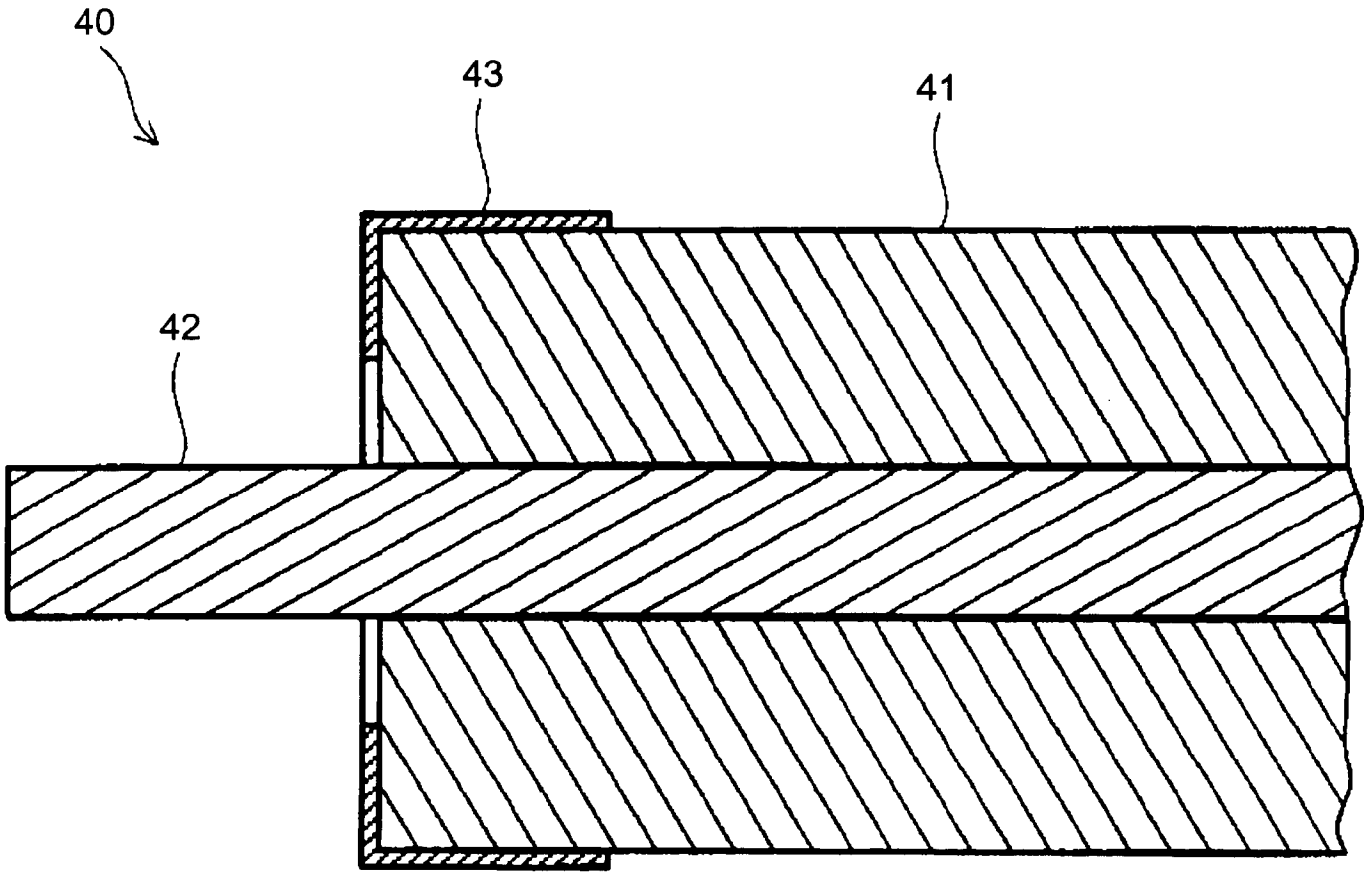
FIG. 7 is a magnified partial view of a vertical cross section of the developing roller shown in FIG. 6.

As shown in FIGS. 6 and 7, the developing roller 40 includes a roller portion 41 that constitutes the surface thereof for absorbing toner and a shaft portion 42. The shaft portion 42 is made of a metal (stainless steel or the like), and the surface thereof is provided with a layer of foam silicone as the roller portion 41. Further, the surface thereof is coated with urethane rubber. The surface roughness of the developing roller 40, i.e., the surface roughness of the roller portion 41 is 0.8-1.2 μm as an arithmetic mean height Ra (JIS B 0601-2001).

Each end portion of the developing roller 40 in the axial direction is provided with a sheet member 43 that covers the surface of the developing roller 40. The sheet member 43 has a tube-like shape without a seam in the circumferential direction and is made of polyethylene terephthalate (PET) that is a heat-shrinkable material with a thickness of 50 μm. In order to set the sheet member 43 to the developing roller 40, the developing roller 40 is inserted in the sheet member 43, which is then heated to be shrunk and is brought into intimate contact on the surface of the developing roller 40. For example, the sheet member 43 is shrunk at 140 degrees centigrade in five minutes or longer.

The surface roughness of the sheet member 43 is 0.6 μm or less as an arithmetic mean height Ra, which is lower than the surface roughness of the developing roller 40 (Ra=0.8-1.2 μm).

In addition, the surface hardness of the sheet member 43 is 2H to 3H of scratch hardness (pencil hardness, JIS K 5600-1999). In contrast, the surface hardness of synthetic resin of the toner base material, which is a mixture of styrene and 2-ethylhexyl methacrylate in the present embodiment, is H to HB of the above mentioned scratch hardness. Therefore, the surface hardness of the sheet member 43 is higher. At this point, the surface hardness of the roller portion 41 of the developing roller 40 is B of the above mentioned scratch hardness.

Concerning the region of the sheet member 43, the length of the regulating plate 38 in the circumferential direction from the contact spot with the developing roller 40 to the end is shorter in the region with the sheet member 43 than in the region without the sheet member 43 as shown in FIGS. 8 and 9. Thus, concerning the space between the developing roller 40 and the regulating plate 38 at the region of the end of the regulating plate 38, the space B in the region with the sheet member is smaller than the space A in the region with the sheet member as shown in FIG. 9 with circles of dot and dash lines.

As described above, the developing device 30 has the developing roller 40 for developing an electrostatic latent image into a toner image by supplying toner and the seal members 39 for preventing toner from leaking from both ends of the developing roller 40 in the axial direction. The developing roller 40 includes the sheet members 43 so as to cover the surface of the end portions in the axial direction of the developing roller 40, and each of the sheet members 43 has a smaller surface roughness than the surface of the developing roller 40 and has no seam in the circumferential direction. Therefore, more slips are generated in the region with the sheet member 43 than in the region without the same, so that the toner hardly enter and remain between the developing roller 40 and the seal member 39 in the former region. Further, the frictional heat between the developing roller 40 and the seal member 39 is also hardly generated. Therefore, it is able to prevent toner from entering, remaining, melting, and fixing between the developing roller 40 and the seal member 39 with a more simple structure that can be realized at low cost. As a result, the developing device 30 that has a long life and can maintain good image quality can be obtained.

In addition, since the surface hardness of the sheet member 43 is higher than that of a synthetic resin that is a base material of toner, damage to the sheet member 43 due to friction with toner can be suppressed. Thus, it is able to enhance the function of preventing the toner from remaining and generation of frictional heat between the developing roller 40 and the seal member 39. Therefore, melting and fixing of the toner in the sealed portion of the developing roller 40 become hardly generated. In addition, since the sheet member 43 having a higher surface hardness than the developing roller 40 is provided to the region to which the seal member 39 contacts, abrasion of developing roller 40 can be prevented.

In addition, since the sheet member 43 is made of a heat shrinkable material, it can be easily provided to the surface of each end of the developing roller 40 by heating and shrinking it. Therefore, it is able to realize the function of preventing toner from entering, melting and the like between the developing roller 40 and the seal member 39 with much lower cost and simpler structure.

Further, the surface of the developing roller 40 is provided with the regulating plate 38 for forming a thin layer of toner, and the regulating plate 38 contacts with the developing roller 40 at one surface, and the length thereof from the contact spot to the end is shorter in the region with the sheet member 43 than in the region without the sheet member 43. Therefore, in the region of the end of the regulating plate 38, the space between the developing roller 40 and the regulating plate 38 becomes smaller in the region with the sheet member 43 than in the region without the sheet member 43. Thus, the quantity of remaining toner between the developing roller 40 and the regulating plate 38 can be reduced in the region with the sheet member 43. Therefore, the function of preventing toner from entering between the developing roller 40 and the seal member 39 can be further enhanced.

In addition, since the above mentioned developing device 30 is provided to the printer 1 in the present invention, it is able to obtain the printer 1 that can prevent toner from entering, remaining, melting, and fixing between the developing roller 40 and the seal member 39 with more simple structure that can be realized at low cost and can have a long life while maintaining good image quality.

Figure 10:
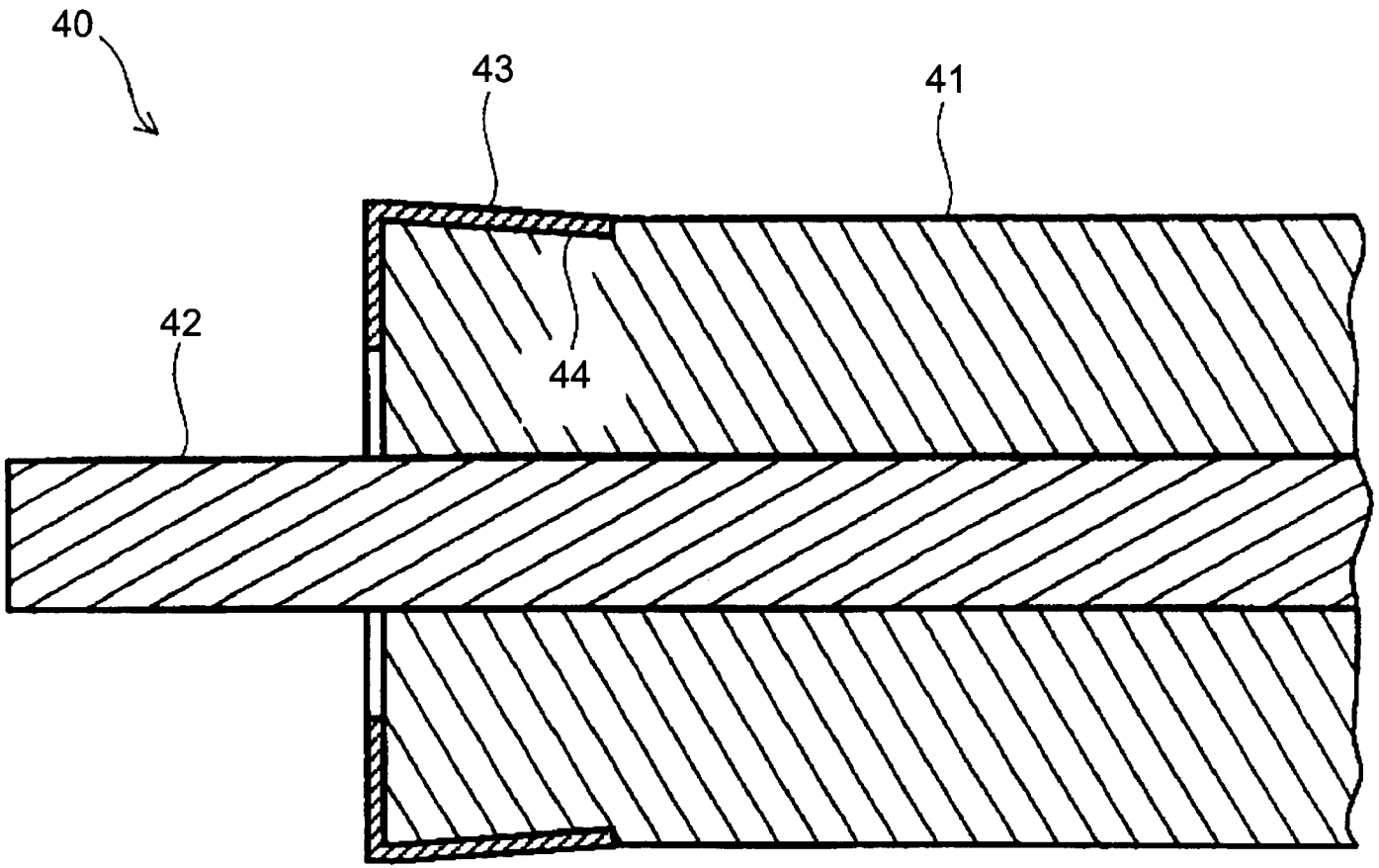
FIG. 10 is a magnified partial view of a vertical cross section of a developing roller of a developing device according to a second embodiment of the present invention.

Next, a detailed structure of the developing device according to a second embodiment of the present invention will be described with reference to FIG. 10. FIG. 10 is a magnified partial view of a vertical cross section of a developing roller of a developing device. At this point, the basic structure of this embodiment is the same as that of the first embodiment described above with reference to FIGS. 1-9, so the drawings and descriptions of the structure that is common to the first embodiment will be omitted.

Concerning the developing device according to the second embodiment, the developing roller 40 is equipped with sheet members 43 that covers surfaces of both end portions thereof in the axial direction as shown in FIG. 10. Although FIG. 10 shows only one end portion of the developing roller 40 in the axial direction, the other end portion is also provided with the sheet member 43.

The developing roller 40 has the recess 44 in the roller portion 41 that constitutes the surface of the developing roller 40. This recess 44 is formed around the circumference surface of the roller portion 41 on both end portions in the axial direction where the sheet members 43 are provided on the outer side of the inner end portion in the axial direction of the sheet member 43. In addition, the recess 44 has the depth such that the surface of the sheet member 43 becomes flat with the surface of the roller portion 41 at the inner end portion in the axial direction of the sheet member 43 and the depth becomes shallower as being closer to the end surface of the developing roller 40 in an inclined manner.

Furthermore, the sheet member 43 is brought into intimate contact with the surface of the roller portion 41, i.e., the surface of the developing roller 40 so that the inner end portion in the axial direction thereof fits in the recess 44 when it is heated and shrunk as shown in FIG. 10. Thus, the sheet member 43 has a local portion having a diameter smaller than the developing roller 40.

In this way, since the sheet member 43 has a local portion having a diameter smaller than the developing roller 40, it is caught in the developing roller 40 and blocks movement of the developing roller 40 in the axial direction. Thus, the sheet member 43 is retained in a predetermined position on the surface of the developing roller 40, so that the function of preventing toner from entering and melting in the sealed portion of the developing roller 40 can work stably.

Figure 11:
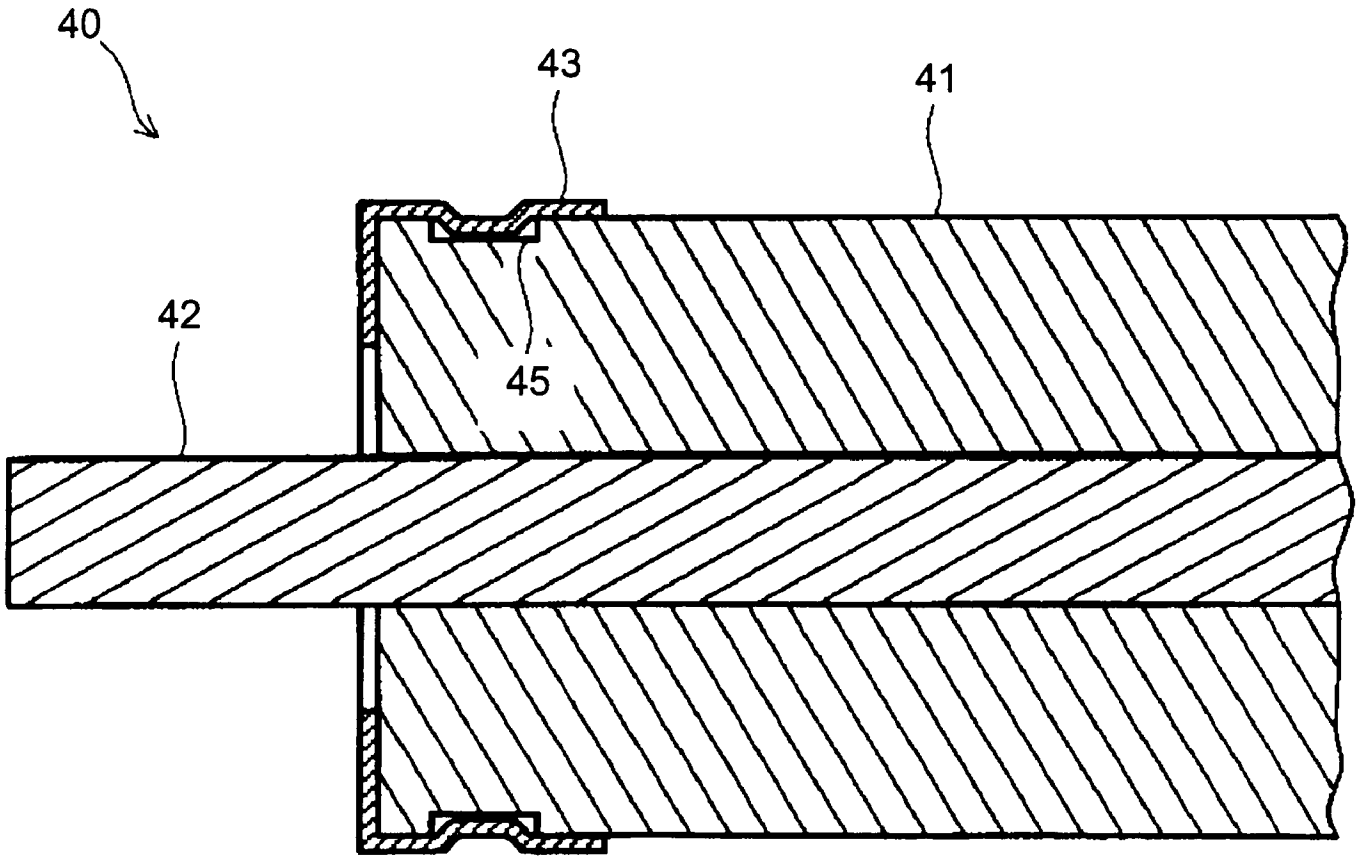
FIG. 11 is a magnified partial view of a vertical cross section of a developing roller of a developing device according to a third embodiment of the present invention.

Next, a detailed structure of the developing device according to a third embodiment of the present invention will be described with reference to FIG. 11. FIG. 11 is a magnified partial view of a vertical cross section of a developing roller of a developing device. At this point, the basic structure of this embodiment is the same as that of the first embodiment described above with reference to FIGS. 1-9, so the drawings and descriptions of the structure that is common to the first embodiment will be omitted.

Concerning the developing device according to the third embodiment, the developing roller 40 is provided with the sheet members 43 that covers the surface of the end portions in the axial direction of the developing roller 40 as shown in FIG. 11. At this point, although FIG. 11 shows only one end portion in the axial direction of the developing roller 40, the other end portion is also provided with the sheet member 43.

The developing roller 40 includes a recess 45 in the roller portion 41 that constitute the surface thereof. This recess 45 is formed around the circumference surface of the roller portion 41 on both end portions in the axial direction where the sheet members 43 are provided on the outer side of the inner end portion in the axial direction of the sheet member 43. In addition, the recess 45 has a constant depth like a groove in the axial direction and in the circumferential direction of the roller portion 41.

Furthermore, when the sheet member 43 is heated, it is shrunk inward so that the region corresponding to the recess 45 conforms the shape of the recess 45, and it is brought into intimate contact with the surface of the roller portion 41, i.e., the surface of the developing roller 40 as shown in FIG. 11. Thus, the sheet member 43 can have a local portion having a diameter smaller than the developing roller 40.

In this way, since the sheet member 43 according to the third embodiment has a local portion having a diameter smaller than the developing roller 40 similarly to the second embodiment, it is retained in a predetermined position on the surface of the developing roller 40, so that the function of preventing toner from entering and melting in the sealed portion of the developing roller 40 can work more stably.

Figure 12:
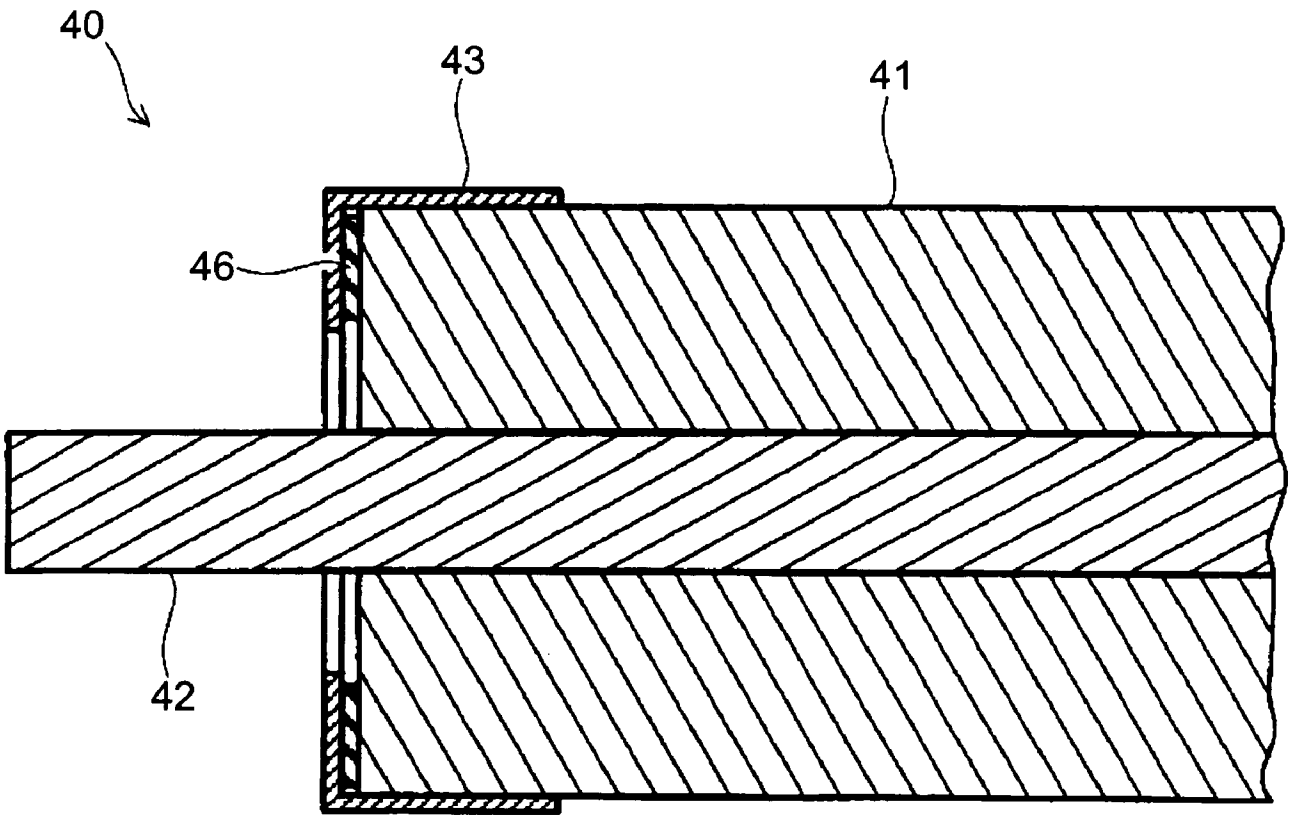
FIG. 12 is a magnified partial view of a vertical cross section of a developing roller of a developing device according to a fourth embodiment of the present invention.
Figure 13:
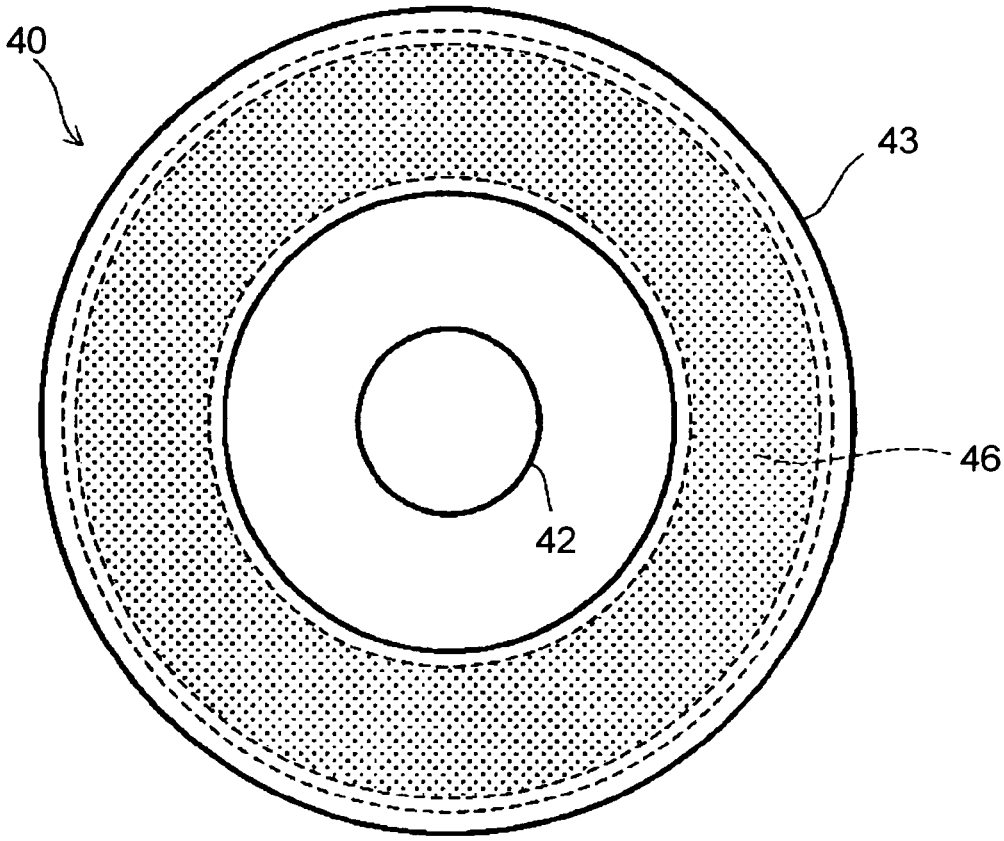
FIG. 13 is a side view of the developing roller shown in FIG. 12.

Next, a detailed structure of the developing device according to a fourth embodiment of the present invention will be described with reference to FIGS. 12 and 13. FIG. 12 is a magnified partial view of a vertical cross section of a developing roller of a developing device, and FIG. 13 is a side view of the developing roller. At this point, the basic structure of this embodiment is the same as that of the first embodiment described above with reference to FIGS. 1-9, so the drawings and descriptions of the structure that is common to the first embodiment will be omitted.

Concerning the developing device according to the fourth embodiment, the developing roller 40 is provided with the sheet members 43 that covers the surface of the end portions in the axial direction of the developing roller 40 as shown in FIG. 12. At this point, although FIG. 12 shows only one end portion in the axial direction of the developing roller 40, the other end portion is also provided with the sheet member 43.

The sheet member 43 covers the region from the surface of the end portions in the axial direction of the roller portion 41 of the developing roller 40 to the end portion of the roller portion 41. An adhering member 46 is provided between the end surface of the roller portion 41 and the sheet member 43 as shown in FIGS. 12 and 13. The adhering member 46 is made up of a donut-like sheet that exerts adhering action when it is heated. Therefore, when the sheet member 43 is heated to be shrunk, the adhering member 46 exerts its adhering function simultaneously to bond the end surface of the roller portion 41 to the sheet member 43.

In this way, the sheet member 43 covers the region of the roller portion 41 of the developing roller 40 from the surface of the end portion in the axial direction to the end surface of the roller portion 41. Since there is the adhering member 46 between the end surface of the roller portion 41 and the sheet member 43, its movement in the axial direction of the developing roller 40 and in the circumferential direction thereof can be prevented. Therefore, the sheet member 43 is fixed securely to a predetermined position on the surface of the developing roller 40, so that the function for preventing toner from entering and melting in the sealed portion of the developing roller 40 can work more stably.

Although the embodiments of the present invention are described above, the present invention is not limited to the embodiments but can be modified variously within the scope of the present invention without deviating from the sprit thereof.

For example, although the printer 1 is the image forming apparatus for color printing that is equipped with the developing device 30 including rotating frame 31 on which the four developing units 32 are disposed at the equal spaces in the circumferential direction and the endless intermediate transfer belt 8 as the intermediate transfer member in the above mentioned embodiment, it may be an image forming apparatus for color printing in a tandem form or an image forming apparatus for monochrome printing in which only black toner is used without using the intermediate transfer member.

In addition, the sheet member 43 is made of polyethylene terephthalate (PET) that is a heat-shrinkable material in the above mentioned embodiment, it may be made of other heat shrinkable material instead of PET or may be made of other material without heat shrinkable property. For example, the sheet member may be made of thermoplastic resin such as polystyrene, polycarbonate, polypropylene, polyethylene and the like as a material other than PET.

Although the structures of the second and the third embodiment of the present invention are exemplified as the structure in which the sheet member 43 has the local portion having a diameter smaller than the developing roller 40, the present invention is not limited to these structures but can have other structure.

In addition, although the fourth embodiment of the present invention uses the sheet that works as the adhering member 46 when it is heated between the end surface of the developing roller 40 and the sheet member 43, the adhering member 46 is not limited to this structure but it may be other adhesive tape or adhesive material. This fourth embodiment can be combined with the above mentioned second and the third embodiment for being used.

The present invention can be utilized generally in all developing devices that can be applied to the image forming apparatus.

What is claimed is:

1. A developing device comprising:

a developing roller that supplies toner so as to develop an electrostatic latent image into a toner image; and a seal member that prevents toner from leaking from end portions in the axial direction of the developing roller to the outside, wherein the developing roller includes a sheet member disposed so as to cover a region from a surface of the end portions in the axial direction of the developing roller to an end surface of a roller portion, and the sheet member has a surface roughness that is smaller than that of the developing roller, and no seam in the circumferential direction.

2. The developing device according to claim 1, wherein the sheet member has a surface hardness that is higher than that of a synthetic resin as a base material of the toner.

3. The developing device according to claim 1, wherein the sheet member is made of a heat shrinkable material.

4. The developing device according to claim 1, wherein the sheet member has a local portion having a diameter that is smaller than that of the developing roller.

5. The developing device according to claim 1, further comprising a regulating plate for forming a thin layer of the toner on the surface of the developing roller, wherein the regulating plate contacts with the developing roller by one surface, and a length from the contact spot to the end is shorter in a region with the sheet member than in a region without the sheet member.

6. A developing device comprising:

a developing roller having a roller portion that supplies toner so as to develop an electrostatic latent image into a toner image; and a seal member that prevents toner from leaking from end portions in the axial direction of the developing roller to the outside, wherein the developing roller includes a sheet member disposed so as to cover a region from a surface of the end portions in the axial direction of the developing roller to an end surface of the roller portion, the sheet member has a surface hardness that is higher than that of a synthetic resin as a base material of the toner and no seam in the circumferential direction, and the synthetic resin has a higher surface hardness than that of the roller portion.

7. The developing device according to claim 6, wherein the sheet member has a surface roughness that is smaller than that of the developing roller.

8. An image forming apparatus equipped with a developing device according to claim 1.

9. The developing device according to claim 6, wherein the sheet member is made of a heat shrinkable material.

10. The developing device according to claim 6, wherein a sheet shaped adhering member is provided between the end surface of the developing roller and the sheet member.

11. The developing device according to claim 6, further comprising a regulating plate for forming a thin layer of toner on the surface of the developing roller, wherein the regulating plate contacts with the developing roller by one surface, and a length from the contact spot to the end is shorted in a region with the sheet member than in a region without the sheet member.

12. The developing device according to claim 1, where a sheet shaped adhering member is provided between the end surface of the developing roller and the sheet member.

* * * * *